US007118107B2

(12) United States Patent
Niedner et al.

(10) Patent No.: US 7,118,107 B2
(45) Date of Patent: Oct. 10, 2006

(54) ROLE-PLAYING GAME WITH INTERACTIVE CARDS AND GAME DEVICES, NAMELY IN THE FORM OF LINEAR AND ROTARY SLIDE RULES, NOVEL USE OF DICE, TACTICAL COMBAT, WORD-BASED MAGIC, AND DYNAMIC ATTRITION

(76) Inventors: Matthew Frederick Niedner, 3982 Valeta St., Apartment 270, San Diego, CA (US) 92110; Barton Frederick Niedner, 417 S. Second St., Saint Charles, CA (US) 63301; Kelly Dwayne Cope, 420 Chelsea Way Dr., Saint Charles, MO (US) 63304

( * ) Notice: Subject to any disclaimer, the term of this patent is extended or adjusted under 35 U.S.C. 154(b) by 593 days.

(21) Appl. No.: 10/167,969

(22) Filed: Jun. 13, 2002

(65) Prior Publication Data

US 2003/0094759 A1 May 22, 2003

Related U.S. Application Data

(60) Provisional application No. 60/297,820, filed on Jun. 14, 2001.

(51) Int. Cl.
*A63F 3/00* (2006.01)

(52) U.S. Cl. ..... 273/236; 273/308

(58) Field of Classification Search ..... 273/292, 273/236, 241, 255, 262, 288, 308, 284, 243; 463/9, 30, 1; 283/65, 68
See application file for complete search history.

(56) References Cited

U.S. PATENT DOCUMENTS 5,954,332 A * 9/1999 Mero et al. ..... 273/236
6,017,034 A * 1/2000 Hennessey ..... 273/296
6,322,077 B1 * 11/2001 Braunlich et al. ..... 273/292
6,435,508 B1 * 8/2002 Tavel ..... 273/292
6,554,702 B1 * 4/2003 Mahar et al. ..... 463/11
6,561,513 B1 * 5/2003 DeGeorge ..... 273/262
6,601,851 B1 * 8/2003 Sakamoto et al. ..... 273/308
2002/0180150 A1 * 12/2002 Weisman ..... 273/236
2003/0071414 A1 * 4/2003 Weisman ..... 273/236

OTHER PUBLICATIONS

Website:wikipedia.org/wiki/Dungeons_&_Dragons, 12 pages.*
Gary Gygax, Advanced Dungeons & Dragons 1979—TSR Games, selected pages.*
Gary Gygax, Advanced Dungeons & Dragons 1979—TSR Games, selected pages.*

* cited by examiner

*Primary Examiner*—Xuan M. Thai
*Assistant Examiner*—Alex F. R. P. Rada, II

(57) ABSTRACT

Provided herein is a role-playing game with physical game devices, cards, and dice as well as rules for their use. Gamers assume the roles of imaginary characters in a fictitious storyline and use game devices, cards and dice to facilitate conflict resolution in the domains of physical combat, magical forces, and technological abilities. Game devices are interactive slide rules that force strategic resource allocation and exhibit dynamic attrition. Cards representing skill with certain devices may be inserted into ports of those name devices to modify their performance. Cards representing maaic words combine together according to the desian on the card perimeter and rules of grammar, allowing characters to compose many magic effects from a relatively smaller set of magic words. Gamma components are customizable and may be obtained from retail outlets. Internet download sites, trading with other enthusiasts, and winning components at tournaments.

5 Claims, 6 Drawing Sheets a o s q h b i n s i c

Fig.5 Method Flowchart for Playing Game
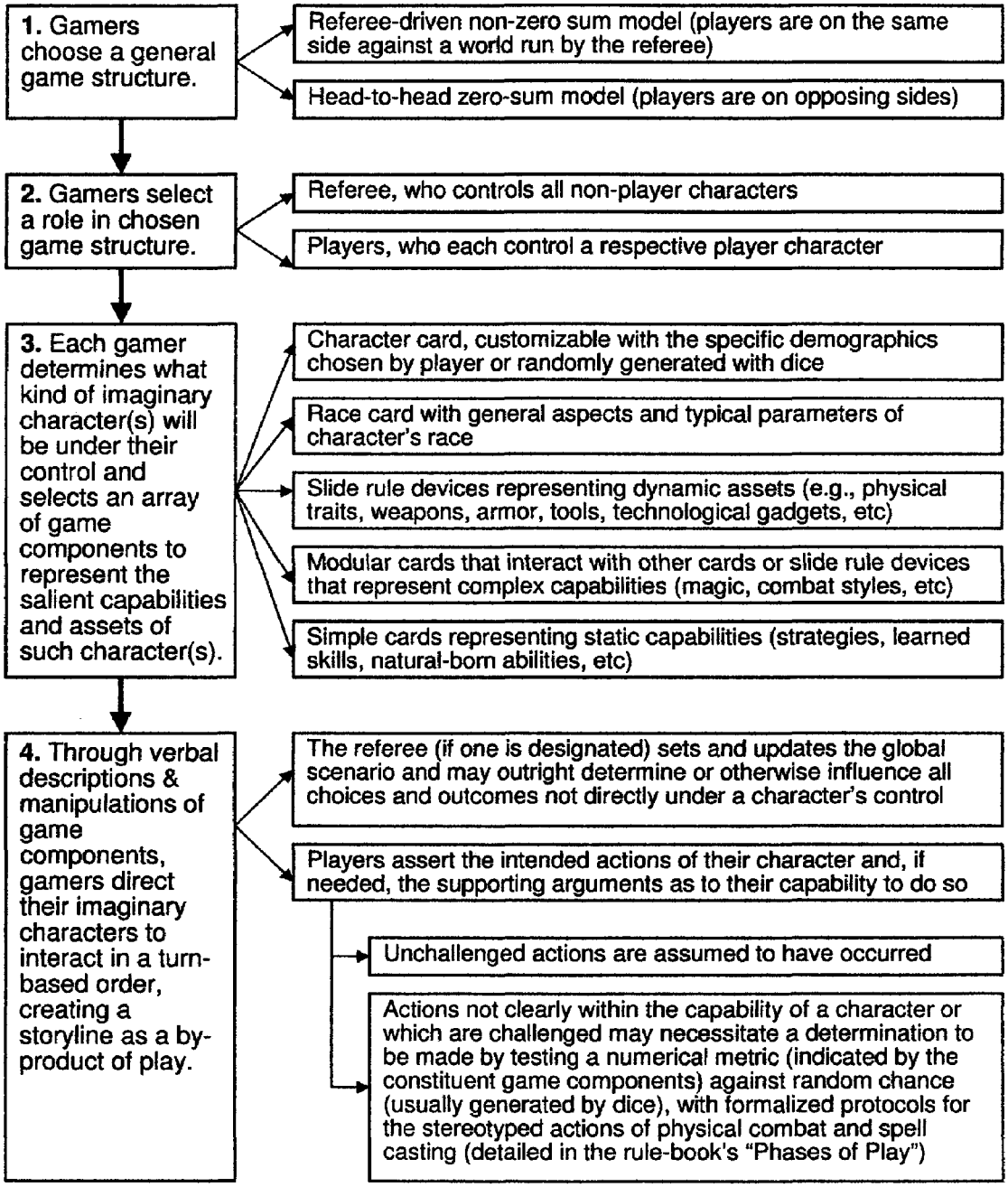

Fig.6 Method Flowchart for Phases of Play During Conflict Resolution
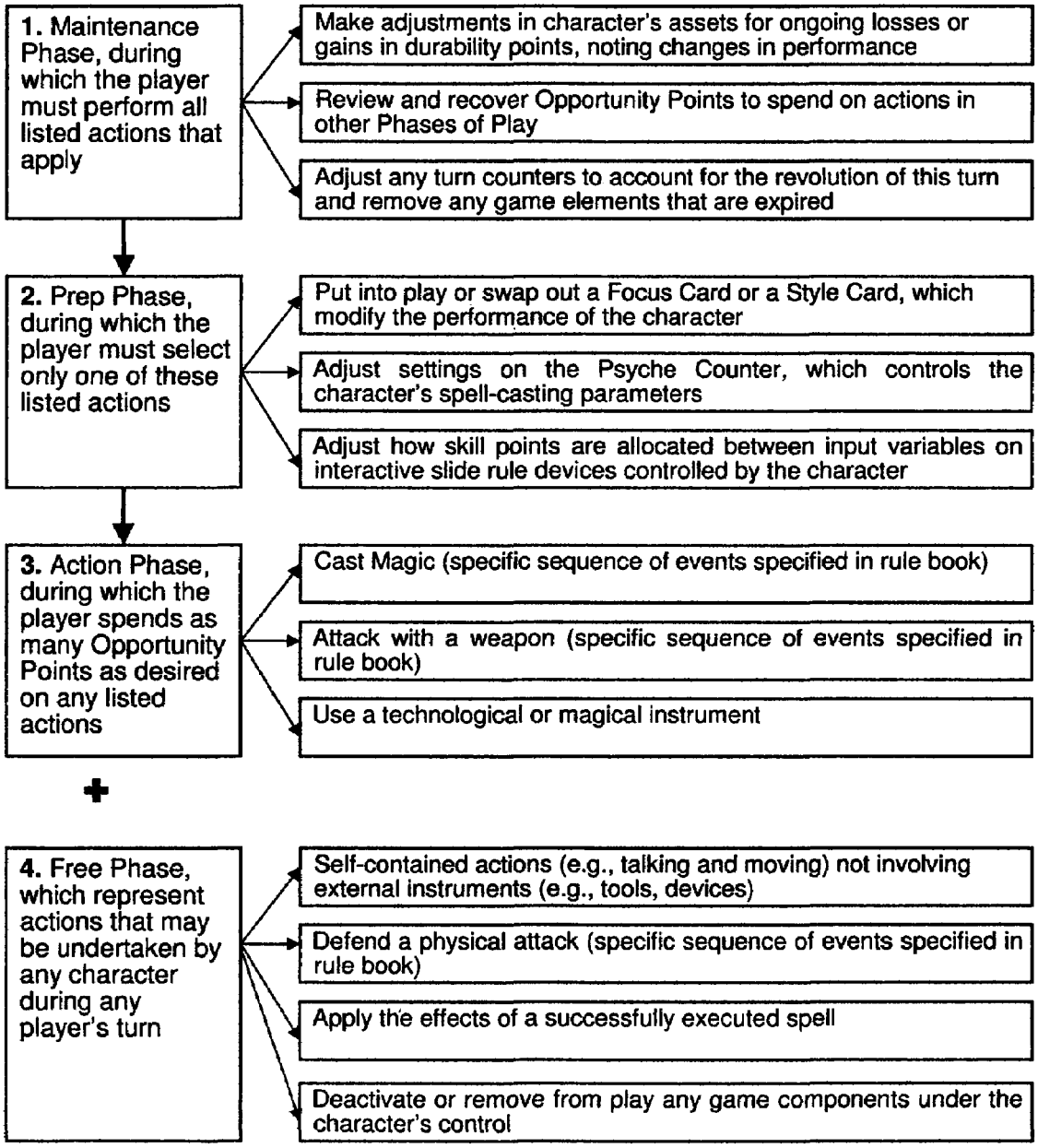

ROLE-PLAYING GAME WITH INTERACTIVE CARDS AND GAME DEVICES, NAMELY IN THE FORM OF LINEAR AND ROTARY SLIDE RULES, NOVEL USE OF DICE, TACTICAL COMBAT, WORD-BASED MAGIC, AND DYNAMIC ATTRITION

CROSS-REFERENCE TO RELATED APPLICATIONS

This Utility Patent relates to prior submissions, namely materials associated with Provisional Patent No. 60/297,820 filed on Jun. 14, 2001, as well as Disclosure Document Number 475082 filed on Jun. 2, 2000. The names of the inventors in all instances are: Matthew Niedner, Bart Niedner, and Kelly Cope. The title of the invention in prior references is as above.

STATEMENT REGARDING FEDERALLY SPONSORED RESEARCH OR DEVELOPMENT

Not applicable.

BACKGROUND OF THE INVENTION

The present invention relates to the field of Role Playing Games, more particularly an improved method and array of game pieces. There is a long and noble history of war games throughout military history in which fictitious scenarios of conflict are played out utilizing tactical rules for conflict resolution. From these sprang Role Playing Games (RPGs) in the late twentieth century. The archetype and still industry standard is Dungeons & Dragons, created by Gary Gygax (copyright 1979). Myriad RPGs ensued, filling many genres, each with various systems for conflict resolution. Because of their open-ended nature (in contrast to board games or card games), RPGs are very dependent on the use and availability of a large amount of information, traditionally in the form of instruction and database texts or volumes, used in conjunction with dice as a means of chance. Because RPGs attempt to anticipate any possible circumstances and actions gamers may take, the amount of reference material to manage fictitious worlds, storylines, and characters becomes unwieldy. Game play is slowed down by continuous need of referencing data, and furthermore, conflict resolution is distilled down to simplistic chart-based mechanisms that provide little tactical control and dry numerical outcomes instead of qualitative and colorful consequences. Furthermore, the more exhaustive an RPG resource book is, the more studying the referee and gamers must undertake before a game can be played, having the unfortunate tendency of making RPGs unappealing to many potential players.

In the 1990's, a paradigm shift occurred in fantasy gaming. Many players of RPGs opted instead for Collectable Card Games (CCGs), such as Magic: The Gathering by Garfield (U.S. Pat. No. 5,662,332). There was an explosion of CCG variants in the 1990's. These CCGs incorporated fantasy imagery, numerical and qualitative mechanics for conflict resolution, and a means of describing the effects of skills as well as technological and magical powers. In the form of a card game, the game pieces were largely standardized and self-explanatory, minimizing the need for reference books. Furthermore, once a few core game concepts were understood, gamers could utilize a vast array of cards to add extensive variation to their gaming content and style. The ease of learning and the rich tactical interaction of collectable components drew many new players to the genre of fantasy games. The shortcoming of CCGs, however, is a kind of game that is inherently limited to the card-play mechanics with a "last-man-standing" type victory. CCGs also lack the creative narrative created in the enactment of characters in an RPG. Many CCG players have lost interest in such games after the novelty of the imagery and mechanics wore off, as the games did not contain the potential for unlimited adventures and conflict scenarios that RPGs offered.

There have also been attempts at combining the open-endedness of RPGs with the playability of CCGs. An example of this is SAGA's Dragonlance card-based RPG (copyrighted, but not patented), which did not achieve much success largely because it simply substituted cards and the deck-drawing randomness of CCGs for the texts and dice randomization classically used in RPGs. Furthermore, the cards of these CCG-mechanic-based RPG's have often been referential, requiring comparisons to resource books. The result has been games with poor tactical control, limited flexibility, and an alternate form of randomization. There are no widely played games of this RPG-CCG hybrid type.

Many games, including RPGs, CCGs, and board games, use familiar devices—specifically, cards, slide-rules, and dice. While many patents exist regarding card games, few concomitantly use dice, none include cards which may be inserted into slide-rule game devices. An example of a RPG using cards and dice is by Mero (U.S. Pat. No. 5,954,332), however, dice are used to assign values to the cards, and card interactions represent creatures position and potency, not character abilities. Fantasy Baseball by Crowder (U.S. Pat. No. 5,145,173) uses traditional baseball trading cards in conjunction with a standard 52-card deck of playing cards and dice. However, the cards represent only players of a baseball team, the dice do not determine potency of action nor multiple simultaneous outcomes, and the cards are not directly interactive with other game components. Further, while there are cards games and teaching tools which employ word-card combinations (e.g., U.S. Pat. Nos. 5,564,710; 4,419,080; 4,171,816), none employ the alignment of color-coded perimeters to obviate the need for grammar comprehension in the assembly of sentences, and none are directed at combining words to represent magical effects in a role-playing game. Likewise, there are many examples of application-specific slide-rules (e.g., U.S. Pat. Nos. 5,014,438; 4,611,113; 4,241,867; 3,986,002). However, none represent the theoretical function of tools and weapons in a role-playing game, and none claim receiving ports within the sliding component itself for optional modular cards. Furthermore, RPGs and CCGs classically have attrition of life that is bimodal: alive or dead. As points of life are lost in most RPGs and CCGs, imaginary beings do not a lose potency or ability. In no game is a slide-rule used to track life while simultaneously correlating it point-by-point to the abilities or prowess of a player's character. Lastly, dice are employed in many games as the means for generating randomness, suspense, and outcome. Among RPGs, many employ two ten-sided dice read in sequence to generate a percentile, or number between one and one hundred. However, no games to date employ the simultaneous use of a percentile roll and an independent use of the constituent digits (e.g., the one's place), effectively making one percentile roll generate a number between one and one hundred and a second independent number between one and ten.

From this becomes apparent the shortcomings of RPGs, CCGs, and prior attempts to combine the two. A need therefore still exists for a method and system which address the shortcomings of these kinds of games. In view of the prior art, there is a need to develop a system, method, and component set which reduces or eliminates the need of reference materials during play, makes learning the game easy and quick, incorporates graphic imagery, provides tactical and creative control to permit strategic game piece deployment, yet remains flexible and open-ended to maintain gamers interest in a creative storyline. It is also apparent that there are novel ways in which to deploy familiar devices—such as cards, slide-rules, and dice—to facilitate this need. It is therefore an object of the present invention to provide such a system, method, and component set that fulfills these needs.

BRIEF SUMMARY OF THE INVENTION

Provided herein is a novel method of game play and constituent game components. The game, which may hereafter be referred to as StoryForge, is a Role-Playing Game (RPG) with physical game pieces and rules for their use, where gamers assume the roles of imaginary characters in a fictitious storyline. StoryForge places specific emphasis on character composition, physical conflict resolution, magical powers, and the performance of tools and technology. One objective of StoryForge is to provide role-playing organization that is simple, and physical game pieces that incorporate strategy, chance, and imagery—while simultaneously increasing the playability of otherwise complex game piece interactions. StoryForge is designed in a modular way, and any module (e.g., systems of combat, magic, or immortality) could be used independently to support the role-playing objectives of gamers. Gamers play the role of imaginary characters, which are described by demographic information as well as numerical representations of attributes, skills, and abilities—higher numbers denoting greater prowess or ability. Unlike other games with game pieces, such as card games or board games that are not open-ended, in StoryForge, player characters interact in open-ended and imaginative ways under the direction of a referee, or under an agreed-upon system for negotiating ambiguous situations. StoryForge is distinguished from other RPGs by rule content, as well as a diversity of physical gaming cards and devices that interface with the novel rules. The majority of RPGs do not use, or at least do not require, physical game pieces. In StoryForge, some gaming components are represented in a static card format, containing information on their uses and effects. These cards become game pieces (and not merely reference materials) when they interact physically or systematically with other cards and components in the game. For instance, casting magic involves aligning arrows and colors on the edges of magic-word cards to write complete magic sentences, which become spells, and combat style cards may be inserted into slide rule type weapons. These more complex, interactive gaming devices—called Artifacts—have variable counters that act as an input-output calculators or data-restriction filters. Artifacts represent weapons, tools, or technologies and function as complex linear slide rules with rotary disk counters, where a gamer inputs values representing ability, chance, or circumstance on the counters and slides, and the Artifact reveals its effects or potential effects. Furthermore, the characters and their abilities are described with cards and counters. Slide rules for Physical, Mental, and Spiritual life points are descriptive of a character's race and reflect degrees of individual prowess or weakness, point-by-point. Other game pieces include counters that track changing game parameters—such as the Opportunity Counter for points spent on actions, and the Psyche Counter for points spent on magical powers.

Objects of the invention which demonstrate novelty and improvement over the prior art include: a rapidly learned RPG; a RPG with tactile and tactical game components, inviting use and strategy; a RPG with flexibility in the degree of gaming complexity, allowing advanced players control over many details, yet permitting learners to play a more simple version simultaneously; efficiency of dice rolling wherein a single dice roll generates multiple independent outcomes; a combat system with interactive slide-rule weapons enhanced with modular components that enable characters to have colorful, customizable combat effects atop the basic numerical damage; a magic system where powers are word-based, instead of list-based, permitting many permutations of a few unitary word-effects; dynamic attrition of a character's life or Artifact's durability where progressive losses culminate in reduction of capability; a RPG which permits gamers to function with the same mechanics over vast character sizes and power differentials; a game which is at once comprehensive and modular; a RPG which can support any genre of role-playing (e.g., fantasy, science-fiction, historical); gaming mechanics which can be utilized intensely for tactical realism and fun, yet can also recede into the background of a more narrative game; a game that serves to educate gamers in language, strategy, and humanities.

In its preferred embodiment, the RPG consists of a text volume of gaming guidelines, playing cards that represent aspects of fictional characters and their abilities, slide-rules that represent the life points and numerical traits of characters, and handheld devices representing tools, weapons, and technologies comprised of multiple slide-rules and rotary disks. Required for use would be a set of standard RPG polyhedron dice. The physical game components, specifically the cards and Artifacts, are preferably represented on paper, wax-impregnated paper, or laminated paper, however, representation on plastic or digital media is also feasible.

Although StoryForge is described above in a standard format comprised of cards, counters, and interactive devices deployed on a flat playing surface, game components may take other forms and different media—such as board games, electronic games, video games, computer games, simulators, and interactive networks. Gaming components may be obtained from retail outlets, Internet download sites, trading with other enthusiasts, and winning components at tournaments.

Figure 1A:
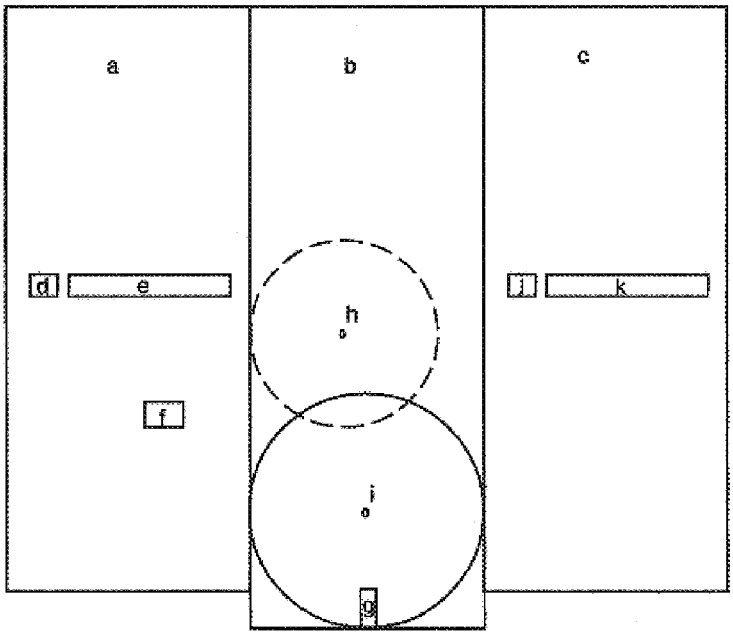
FIG. 1A: an unfolded melee weapon Artifact sheath.
Figure 1:
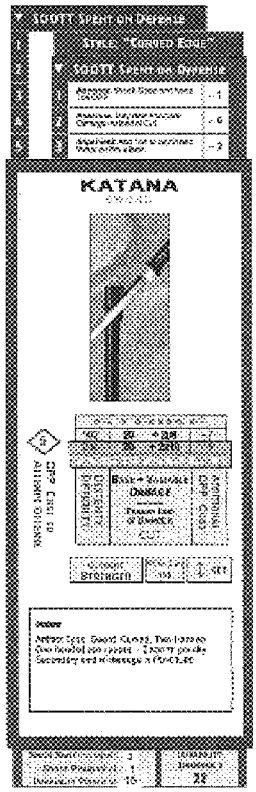
FIG. 1: an assembled melee weapon Artifact as it appears from the offensive side.

Legend to Letters for FIG. 1:

a—offensive face plate.

b—center plate.

c—defensive face plate.

d—viewing aperture for q (ID).

e—viewing aperture for q (ID).

f—viewing aperture for viewing aperture r for disk h.

g—viewing aperture for disk i.

h—adjustable disk for durability.

i—adjustable disk for power.

j—viewing aperture for n (1C).

k—viewing aperture for n (1C).

l—port for card s (1E).

m—outline of viewing aperture m (i.e., aperture is on reverse side).

n—defensive SOOTT slider (backside showing) (1C).

o—port for card s (1E).

p—viewing aperture for card s in port 1.

q—offensive SOOTT slider (1D).

r—viewing aperture for disk h.

s—style card for ports o and l, to be viewed through apertures p and m.

Figure 2:
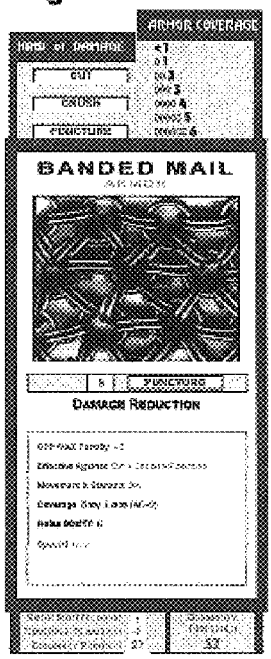

FIG. 2: an assembled armor Artifact as it appears from the front.

Figure 2A:
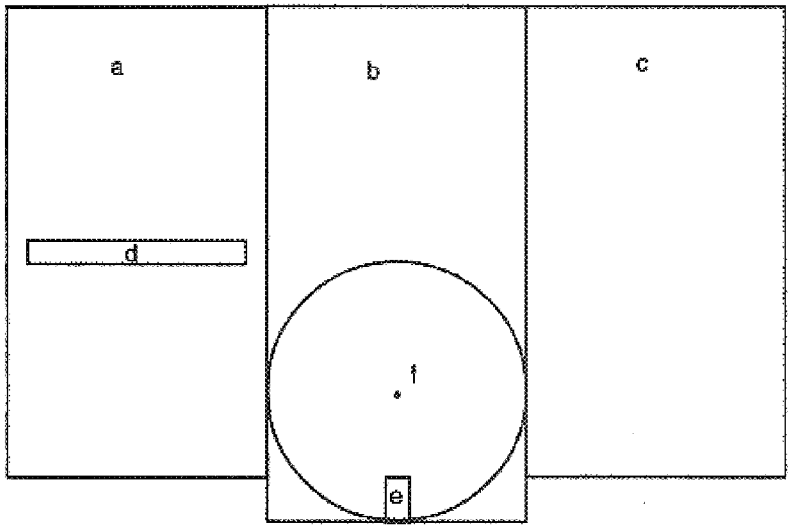

FIG. 2A: an unfolded armor Artifact sheath.

Figure 2D:
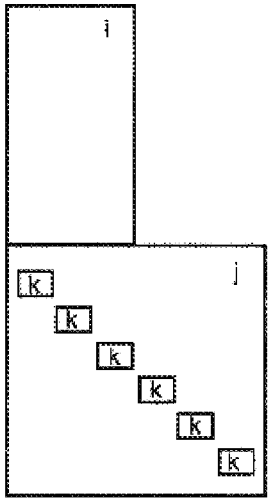
Figure 2C:
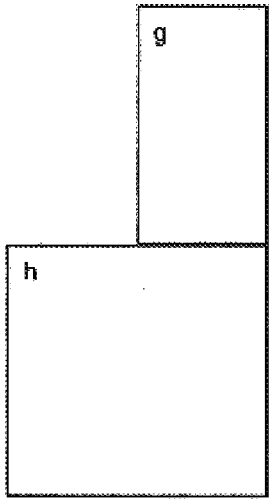
Figure 2B:
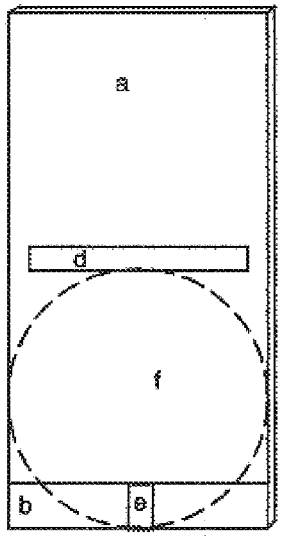

FIG. 2B: a folded armor Artifact sheath as it appears from the front.

FIG. 2C: an armor coverage adjustable slider, which inserts into the sheath.

FIG. 2D: a damage type adjustable slider, which inserts into the sheath.

Figure 2E:
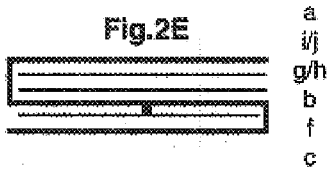

FIG. 2E: an assembled armor Artifact as it appears from the top; Column of letters indicates the 6 layers as read from the front face plate to the back face plate.

Legend to Letters for FIG. 2:

a—front face plate.

b—center plate.

c—back face plate.

d—viewing aperture for viewing aperture k for slider h.

e—viewing aperture for disk f f—adjustable disk for durability.

g—tab to armor coverage adjustable slider (2C).

h—data zone for armor coverage adjustable slider (2C).

i—tab to damage type adjustable slider (2D).

j—aperture zone for damage type adjustable slider (2D).

k—viewing apertures for h.

Figure 3A:
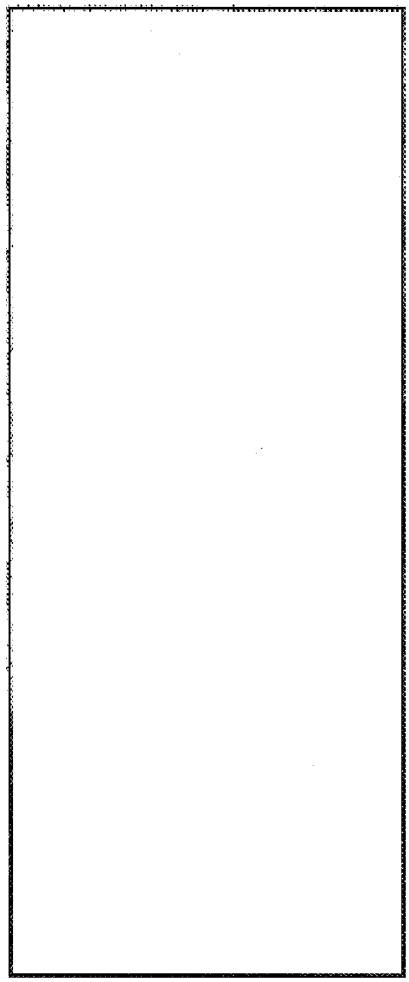
Figure 3:
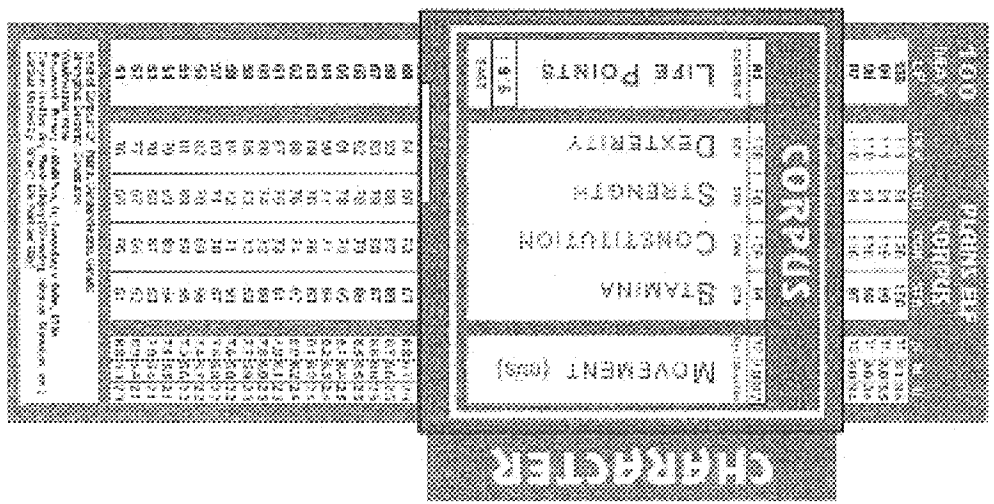

FIG. 3: an assembled attribute counter as it appears from the front.

FIG. 3A: an attribute adjustable slider.

Figure 3B:
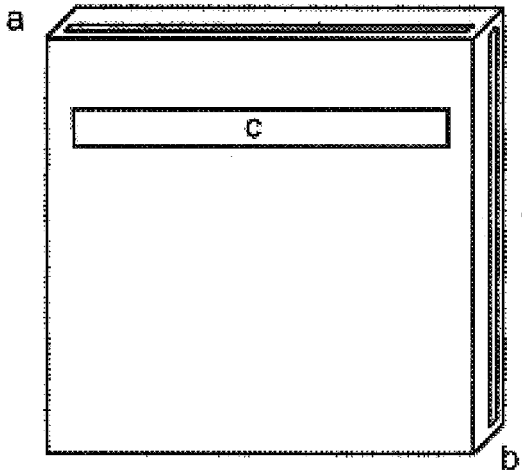

FIG. 3B: an attribute sheath.

Figure 3C:
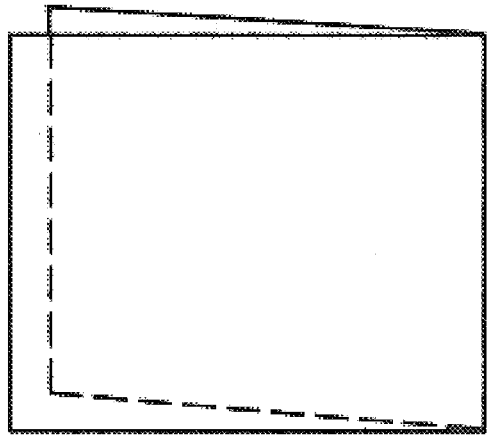

FIG. 3C: a folding information sheet.

Legend to Letters for FIG. 3:

a—vertical sheath for 3A.

b—horizontal sheath for 3C.

c—viewing aperture for 3A.

Figure 4A:
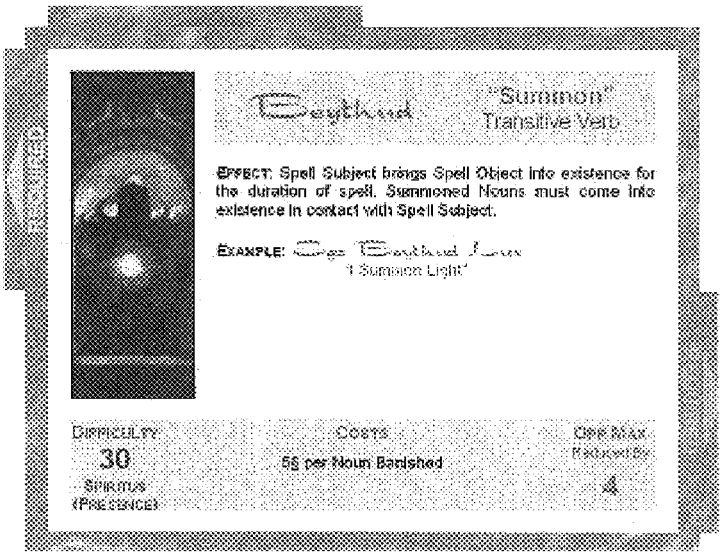
Figure 4A:
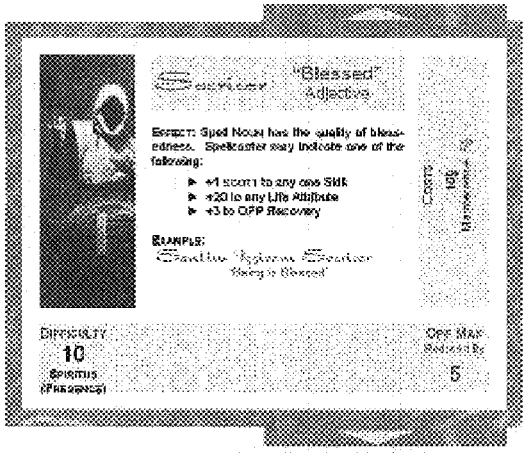

FIG. 4A: Locution card with iconic and color-coded borders indicating proper card-card interactions.

Figure 4B:
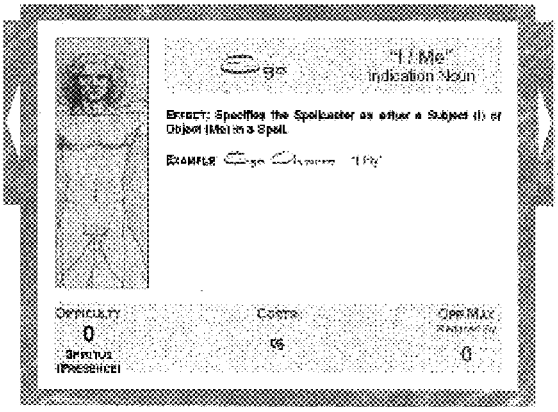
Figure 4B:
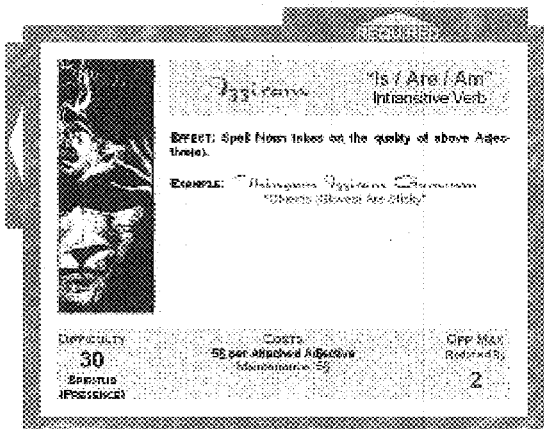

FIG. 4B: Locution cards arranged into a complete spell in accordance with interactive borders.

FIG. 5 Method Flowchart for Playing Game

FIG. 6 Method Flowchart for Phases of Play During Conflict Resolution

DETAILED DESCRIPTION OF THE INVENTION

The Present invention, which may hereafter be referred to as StoryForge (SF), is a system of role-playing, enabling participants to enact the part of an imaginary being in a fantasy world. SF is modular and modifiable, allowing gamers to incorporate or adapt only the desired components. Gamers take one of two main roles: the Players or the Fates. Most gamers will be a Player, running one or more Player Characters (PCs) in a storyline guided by the Fates. Typically one gamer plays the Fates, and would be considered the Referee. The Fates administer the Non-Player Characters (NPCs)—all those imaginary beings not run by Players. SF is a support tool to allow a creative, colorful, and interactive narrative to be woven by several gainers. The primary objective is for gamers to take part in an adventure, and create a wonderful tale in the process. However, the objective of the game may be changed to something more closely approximating zero-sum games, where gamers simply have a duel to the death. The tale to be told can be a saga that encourages days of play, or a single vignette, that may entertain gamers for an hour. The objective and scope can be whatever the gamers so choose.

SF is a departure from traditions in RPGs. SF mechanics are well thought out, motivated by principles and realism, not arbitrary numbers and tables. The same mechanics apply to many instances, instead of having many tables and references. Game components usually explain their own function—decreasing dependence on manuals. Combat consequences are firm, creating a realistic disincentive to engage in reckless combat, in contrast to other RPGs. Casting magic is creative and word-based, allowing players to write the spells they need, instead of pre-selecting them from lists as in other RPGs. Players are unlimited in playable races, size, and degree of immortality. There are not prohibitions or separate mechanics for "playable" and "non-playable" beings, as in most RPGs which restrict players to mortal humanoid beings. Additionally, SF incorporates tangible Artifacts that are fun to handle; images that provoke the imagination; and literary, mythological, and historic references for personal enrichment.

Requirements to play include two or more gamers to enact imaginary characters, a somewhat premeditated scenario or storyline in which the characters interact, a standard set of polyhedron dice (4, 6, 8, 10, 12, and 20 sided), the Guide (or rulebook) which explains the SF system, and some combination of SF Components, which will be detailed throughout this description.

A Character, in the broadest sense, is the fictitious person that a Player controls. Practically, it is the total set of gaming components collected together that are run by a Player. The Character Card (FIG. 3C) contains the essential information that describes a specific Character. It has a red border and inserts into the side pocket of the Corpus Sheath (FIG. 3B)(described later). The card may be prepared in several ways: prefabricated, entered manually on a blank form, or designed on the internet and printed. The Character Card (FIG. 3C) has two leafs. On the front of the Character Card (FIG. 3C) is demographic information, including name, race, gender, and physical specifications such as size, weight, and race-relative beauty. Additionally, there is space for an image of the character. On the back of the Character Card (FIG. 3C) there are two columns of Skills. The SF System Skills include those skills that need to be identified to make SF mechanics work when using game components. These are divided into Melee Weapons, Range Weapons, and Magic. The remaining Skills can be anything a Player desires—broad or general—to describe the abilities of their character. Unlike other RPGs that predefine character professions, restrict abilities to races, and pre-assign points that may be spent on character development, SF has a completely open character generation system. There are no arbitrary stipulations that certain races can only be certain professions. To be specific, in SF, there are no formal professions—only skills. If a character is great with a bow, he could be called an Archer. If he is powerful with deceptive magic, he could be called an Illusionist. The skills define the profession, not the other way around. Gamers are encouraged to develop their own Skill titles and use them loosely. They can be General or Specific (e.g., Sword Combat vs. Rapier Combat). There are no formal lists from which to choose all possible skills, nor a certain number that may be had. Whatever Skills seem appropriate should be selected for the character in the context of creating an interesting story. There are, however, several Skills particular to the SF system that allow gaming mechanics to function, and these include:

| | |
|---|---|
| Weapons (hand held): | |
| Body: | Skill when fighting with the Body (i.e., punching, martial arts, biting) |
| Sword | Skill using Sword (e.g., claymore, katana) |
| Knife | Skill using Knives (e.g., dagger, tanto) |
| Hafted | Skill using Hafted Artifacts (e.g., axe, mace, club, pick) |
| Pole-Arm | Skill using Pole-Arm (e.g., spear, halberd, glaive, staff) |
| Projectiles: | |
| Thrown/Sling | Skill using Thrown Artifacts (e.g., stone, spear) |
| Bow | Skill using Bow Artifacts (e.g., longbow) |
| Crossbow | Skill using Crossbow or Rifle Artifacts |
| Magic: | Skill with casting spells |

Each Skill is assigned a SOOTT (pronounced "suit", standing for Scale Of One To Ten). This is a very intuitive means of running Skills that does not require extensive tables of Experience Points versus Character Level, as is the case in most RPGs. Players and the Fates are encouraged to use these numbers to invent likelihood values on the spot for any given task that presents itself This process is described in the Fates section later. The Fates should periodically review Players' skills and adjust the SOOTT based on experience, training, education, disuse, etc. Ongoing experience may simply maintain a Skill, and not advance it. Non-use of a Skill may cause atrophy and a decrease in SOOTT. Here is a rough guide to SOOTT:

| SOOTT | Skill Level |
|---|---|
| 0 | Absolutely no experience with the skill |
| 1 | Novice of the skill/Second-hand exposure |
| 2–3 | Student/Apprentice of the skill |
| 4–6 | Typical professional user of the skill |
| 7–9 | Devoted Practitioner of the skill |
| 10 | Master of this skill [usual limit] |

The Races in SF are each described on a Race Card, which can be kept with the Character Card (FIG. 3C) in the side pocket of the Corpus Sheath. It gives reference ranges for usual demographics, a graphic, and some descriptive text. The card will denote typical weights and sizes—usually given in three dimensions: height, width, thickness. These are important for some game play (such as what size weapons and armor are allowed, how hard a small being is to hit with projectiles, the weight a spellcaster must overcome to levitate a target, etc.). This card may also indicate special abilities or certain gaming components that should be used with the particular race (such as the Ability Card "Breath of Fire" to be used with a Fire Dragon). Also, sensory propensities will be denoted on a SOOTT scale (e.g., how good Vision, Hearing, Smell, etc are in general for that race. Race also determines a major magical attribute of a character, namely Immortality. In SF, all living things are considered to be partly immortal—that is, having a persisting life force. Immortality is a reflection of the durability and intensity of a being's life force, and is ranked on a SOOTT scale. This is in contrast to most RPGs where there is only a distinction between mortals and immortals. Each of the ten SOOTT levels in SF represents a category of beings, and their general traits are outlined in the following table. When beings reincarnate in SF, they tend to reincarnate at the same SOOTT, however, they may ascend or descend depending on the storyline. Higher Immortality is typically associated with longer life, greater magical powers, increasing mobility within the universe, greater impact on one's environment, and increasing recall of past lives and those souls one may have met before. Immortality SOOTT is added with Magic SOOTT to determine Psyche Points, which in turn determines magical prowess.

| SOOTT | Category | General Hallmarks | Examples |
|---|---|---|---|
| 0 | Inanimate | Non-Living<br>Do not have "Spiritus" Attribute | Golem, Android |
| 1 | Microscopic Life | Basic life existence - Lack instinct or intention<br>One or a few cells, or self-replicating genetic material | Bacteria, Plankton, Viruses |
| | | Mortals: | |
| 2 | Non-Sentients | Have stronger instinct than intentions; Life Energy is not distinct ("one is like another") | Plant, Insect, Reptile, Fish |
| 3 | True Mortals | Relatively equal power of instincts and intentions;<br>Occasionally recall recent past lives in vague detail | Mammal, Orc, Bird, Human, Halfling |
| 4 | Quasi Mortals | Have stronger intentions than instincts; Commonly recall recent/ancient past lives in vague detail | Elf, Dwarf, Gnome, Demon, Faerie |
| | | Deities: Less affected by natural disease and aging than mortals | |
| 5 | Demi-Deities | Strong emotions manifest in aura; Recall recent past lives in fair detail | Dragon, Angel, Devil, Unicorn |
| 6 | Lesser Deities | Strong emotions manifest in region; Recall all past lives in moderate detail | Lolth, Phoenix, Asmodeus |
| 7 | Greater Deities | Strong emotions manifest in world; Recall all past lives in exquisite detail | Triton, Zephyr, Tiamat |
| | | Gods: Unaffected by disease or aging; Recall all past lives | |
| 8 | Demi-Gods | Strong emotions permeate aura, manifest in region;<br>Might recognize other souls from prior lives | Hermes, Loki, Hestia, Hercules |
| 9 | Lesser Gods | Strong emotions permeate region, manifest in world;<br>Usually recognize other souls from prior lives | Hephaestus, Vulcan, Thor, Isis |
| 10 | Greater Gods | Strong emotions permeate world, manifest in universe;<br>Recognize other souls from prior lives | Zeus, Jupiter, Odin, Osiris, Set |

Each race has a set of three Attribute Sliders (FIG. 3A), one each for Physical, Mental, and Spiritual Life. The Life Points on the Attribute Sliders (FIG. 3A) will define the potency of the four attendant Traits and one special aspect. These are reviewed below and described in greater detail later.

| | | |
|---|---|---|
| CORPUS | | Physical Vitality and Durability (represented in red) |
| [AGI] | Agility | Coordination and control over movement and balance |
| [POW] | Power | Raw physical power, often proportional to size |
| [CON] | Constitution | Quality of assembly/healing; resistance to breakdown and disease |
| [STA] | Stamina | Physical endurance |
| Move | Movement | Given in three numbers: maximum, intermediate, sustainable |
| MENTUS | | Mental Vitality and Durability (represented in green) |
| [ACU] | Acuity | Alertness, speed of thought, mental reaction time |
| [MEM] | Memory | Recall of past events; degree of detail remembered |
| [REA] | Reasoning | Logical, deductive, rational thought; learned anticipation |
| [ABS] | Abstraction | Imagination, creative problem solving, inductive thought |
| Opp | Opportunity | Determines number of points available for Actions |
| SPIRITUS | | Spiritual Vitality and Durability (represented in blue) |
| [PRE] | Presence | Projection and penetration of personality and emotions |
| [WIL] | Will | Determination and resolve; emotional endurance and resistance |
| [MAG] | Magnetism | Social and animal magnetism independent of physical beauty |
| [INT] | Intuition | Instinctual or "gut" feeling; anticipation based on emotion |
| Aura | Aura | Area around being that is magically a part of that being |

The Race Card should correspond to the same-race Attribute Sliders (FIG. 3A). As an example of Attribute and Trait ranges, the table below makes a comparison between a Human, a Goblin (inferior) and a Dragon (superior). Note that the Human Standard is a potential of 100 for everything.

calculator that demonstrates how Traits deteriorate as life is lost (e.g., how Agility worsens as a Character takes physical damage from a sword).

Each race will have a potential maximum value for each Attribute, and as a standard, Humans have 100 potential Life Points of each. However, each individual Character will have a Base value—the value at which an individual begins and to which they recover when at full health (e.g., Corpus of 95 for a human Olympic wrestler). For humans the Traits are also 100 at maximum, and descend in a linear fashion relative to Life Points. Other races may have substantially different Attribute and Trait values, and these may not decrease in a linear manner. A Giant, for instance, may not ever be more agile than a very agile human, but as a Giant loses Corpus life points, his agility may remain more intact than a Human's.

The Attribute Slider (FIG. 3A) may have several leafs (or folds) to accommodate the number of Life Points, depending on the race. The SF system is designed to allow any scale of Attributes. There is no upper or lower limit. By SF convention, each Attribute will be broken down into sensible significant intervals. The standard is a Human with all Attributes and Traits on a Scale of 1–100, using significant intervals of 1 (which is the interval by which the Human Attribute Sliders decrease). Thus, damage less than 1 point is negligible—such as a wasp sting or rosebush scratch. Damage is not rounded. 3.9 points of damage to a Human only deals 3 points, not 4. In comparison, A Gnome with a Corpus of 10 is described in tenths, such that 0.1 point of damage is significant on the Slider (FIG. 3A). A wasp sting or thorn would possibly be enough to reduce life. Conversely, a Dragon with a Corpus of 600 will have a significant interval of 4 Life Points. Damage less than this is disregarded. Corpus life points can also be applied to non-beings. For instance, a castle portcullis could be described as having a Corpus of 10,000, with significant interval of 100. Thus, routinely, no Human attack would injure the gate—but a battering-ram or catapult dealing 100+ damage could.

Some kinds of beings may not have all three Attributes—a golem or android may only have Corpus and/or Mentus; a ghost or spirit may have only Mentus and/or Spiritus; an

| RACE | CORPUS | AGI | POW | CON | STA | MENTUS | ACU | MEM | REA | ABS | SPIRITUS | PRE | WIL | MAG | INT |
|---|---|---|---|---|---|---|---|---|---|---|---|---|---|---|---|
| Goblin | 80 | 100 | 80 | 60 | 80 | 80 | 100 | 80 | 80 | 80 | 80 | 80 | 80 | 40 | 120 |
| Human | 100 | 100 | 100 | 100 | 100 | 100 | 100 | 100 | 100 | 100 | 100 | 100 | 100 | 100 | 100 |
| Dragon | 600 | 300 | 800 | 300 | 100 | 300 | 300 | 600 | 300 | 150 | 300 | 400 | 250 | 200 | 350 |

The three Life Attributes—Corpus, Mentus, and Spiritus—represent Physical, Mental, and Spiritual aspects of the Character in a race-specific manner. Each Life Attribute has four specific Traits and one special aspect associated with it. Attribute Sliders (FIG. 3A) are devices that keep track of Life Points. The Attribute Slider (FIG. 3A) inserts into the Attribute Sheath (FIG. 3B), is initially set to show the starting—or Base—Life Point value in the window, and then may be used as a counter to keep track of losses and recovery of Life Points. If any Attribute falls to zero or fewer Life Points, the Character may be considered unconscious, and dead if a negative value with absolute value greater than the character's Base. For instance, a Human with a base Corpus of 80 would become unconscious at 0 Life Points and die at −80 Life Points. Most importantly, the counter acts as a elemental creature or mystic tree may have only a Corpus and Spiritus. Furthermore, Gamers can invent new races simply by mismatching Attribute Sliders (FIG. 3A) from different races.

At the bottom of each Attribute Slider (FIG. 3A) is a text box that indicates the type of Attribute it is, powers and weaknesses relative to a human standard, how Life Points are gained and lost for that race, and any special notes. Each Attribute Sheath (FIG. 3B) has a description of Traits on the back panel, and a side-pocket into which specific game components slide. This is described in further detail below.

Corpus represents the physical aspects of a Character. Corpus Life Points for most races are lost by physical harm, such as damage from weapons, disease, starvation; and are recovered with time healing, medicines, and rehabilitation.

Certain races may differ (e.g., a Vampire may lose Corpus to sunlight and only heal with the consumption of blood). Specifics are noted at the bottom of the Attribute Slider (FIG. 3A). Movement is also described by Corpus. Speed in meters per second is given for the primary mode of movement, while secondary modes of movement are given on the Slider (FIG. 3A) base with a conversion factor. The 1st column is Maximum speed for [STA] Seconds, 2nd column is Cruise speed for [STA] Minutes, 3rd column is Distance speed for [STA] Hours. Values in between may be estimated Mentus represents the mental aspects of a Character. Mentus Life Points for most races are lost by wakefulness, extreme mental exertion, or certain kinds of injuries to the central nervous system; and are generally recovered with sleep. Certain races may differ (e.g., a photosynthetic plant-being may lose Mentus in the dark, and recover with sunlight). Specifics are noted at the bottom of the Attribute Slider (FIG. 3A). Additionally, different races will tire and require more or less sleep, relative to humans. Opportunity (or Opp) is also described by Mentus. Opp is a kind of currency of action. Each race has a maximum Opp and an amount of Opp recovered each turn for a given level of Mentus life points. Game elements that require Opp (such as Artifacts, Combat Effects, and Spell Cards) usually indicate right on the component how much Opp must be spent (i.e., dialed-down on the Opp counter). Certain instances may also affect Opp, such as wearing heavy armor or receiving stunning blows. Furthermore, since Mentus decreases with wakefulness, Opp may also become impaired when a Character is tired. The Opportunity Counter is a device with three wheels—representing Maximum, Recovered, and Current Opportunity Points—to help Players keep track of these variables during times where it is important. The Opp Counter may be stored in the side pocket of the Mentus sheath, or removed for easier access. Rather than rigid rounds where a character can only do a fixed amount of activity during their turn, SF allows players to have a reservoir of Opp that may be spent on actions within a turn in a flexible manner. Each Race has a Max Opp and an amount of Opp recovered each turn on the Mentus Attribute Slider. These are the natural start values, but the actual Max and Recovered Opp are determined based on other factors and set on the Opp Counter. For instance, if the Mentus Attribute decreases because of long wakefulness or a blow to the head, so does the amount of Opp available to a Character. Things that persistently affect a Character—such as wearing heavy armor, putting a Focus Card into play, or maintaining spells—decrease Max Opp. Furthermore, certain effects will affect Opp, such as receiving a stunning blow, magical charms and curses, and such. But in turn-to-turn play, most focused "one-time" actions, like swinging a sword, decrease Current Opp, which will be recovered. Players can save up Opp, or spend it all in a furious burst of activity, although it may take awhile to recover. Zero Opp equates to an inability to act—even to defend one's self Certain combat maneuvers and spells can cause Players to lose Opp, so having low Opp can be very dangerous. Also, attacking and defending against multiple opponents can really deplete Opp. For free-form actions, the Fates may assign an Opp cost, or Players may agree upon fair values. In general, trivial tasks, such as walking and talking may cost 1–5 Opp, involved tasks 6–10, committed and complex tasks 11–15, intense trance-like multitasking 16–20, etc.

Spiritus represents the spiritual aspects of a Character. Spiritus Life Points for most races are lost by casting magic and profound emotional stresses; and are generally recovered with dedicated prayer or meditation. Specifics are noted at the bottom of the Attribute Slider (FIG. 3A). Spiritus also determines Aura, which is the area around a being that may be considered an individual's magical "personal space"—a part of that being for magical purposes, spell effects, and general life force. For example, if a character casts a Spell to become invisible, objects within their Aura may generally be considered to become invisible too. Spells with direct effects in a Character's Aura are also subject to resistance by that Character (for instance, if a mage were trying to destroy a warrior's sword, the sword would have the same resistance to magic as the warrior as long is it was within the warrior's Aura).

An Ability Card describes just that—an ability of a character. Each character may have one or more of these cards that describe special abilities a character possesses. Each card will describe its exact use and mechanics. In general, these are always available to a character and need not be activated (unless the card indicates otherwise). There are two broad categories:

| | |
|---|---|
| Anatomic: | Based on physical structures (e.g., fire breath, envenoming bite, flying wings) |
| Mystical: | Derived from an unlearned or supernatural source (e.g., healing touch, telekentics) |

Abilities are inherent to a Being, either because of special anatomy, or due to mystical or supernatural prowess. They are distinguished from Skills, which are generally acquired or learned. Some functions may be considered either—for instance a Ranger would have the learned Skill to "Track" subjects, while a bloodhound would have the innate Ability to "Track" due to an excellent sense of smell. Likewise a bird has the ability to fly because of wings, or superman because of supernatural forces.

A Focus Card describes an aspect of character that is very active. A Character may have many Focus Cards, but may only have one Focus in play (active) at any given time. When a Character puts a Focus in play, it usually modifies game mechanics for that Character—such as Opportunity, SOOTT, Difficulty Rolls, Artifact performance, etc. There are three kinds of Focus Cards:

Physical Posture: Corpus Trait difficulty to put into play; describes effects of a physical stance (e.g., footwork);

Frame of Mind: Mentus Trait difficulty to put into play; describes effects of concentration (e.g., patience);

Emotional State: Spiritus Trait difficulty to put into play; describes effects of prominent emotions (e.g., rage).

Each Character may make one attempt to put any Focus Card into play during their Prep Phase by making a Difficulty Roll and paying the Costs (Opp, Opp Max, Life Points, or whatever is specified on the card). At any time, the Player may discard the Focus. Alternately, a Focus may be discarded because another Character's actions or cards may demand it. Lastly, circumstance or the Fates may determine that certain events or activities interfere with a Focus, and the Player may have to discard a Focus.

Mythologically, the Fates were a trinity of divinities to the ancient Greeks. By their names: Clotho spun the web of life; Lachesis measured its length; and Atropos cut it off. In StoryForge we refer to The Fates together, as the set of forces that control Characters' destinies. StoryForging can be considered an interaction between three factors, no one of which is in total control of a storyline:

| | |
|---|---|
| Characters: | the fictitious beings under the control of Players |
| The Fates: | the fantasy world and non-player characters (NPC's) under control of game-master(s) |
| Fortune: | the dice used by Players and The Fates - making luck and chance possible |

Dice are used to generate randomness in SF. The SF system uses a standard set of polyhedron dice familiar to all RPG gamers. Specifically, SF requires 4-, 6-, 8-, 12-, 20-, and two 10-sided dice. The standard notation for polyhedron dice in RPGs is #d#, where the first # indicates how many dice, and the second # indicates what kind (e.g., 2d6 means two six-sided dice). Constants may be added, such as 20+2d6 (meaning the sum of 20 plus the value of two two six-sided dice. Most commonly, SF uses random numbers 1–10 and 1–100. When rolling 1–100, two distinguishable 10-sided dice are rolled, where a Player has determined beforehand which dice will be read first (e.g., a "3" and a "7" would be read as 37). This is called a percentile roll. The convention with 10-sided dice is that "0" is actually 10 when one is when one is rolled, and "00" is 100 when a percentile is rolled.

An "Attempt Roll" is a general term applied to percentile dice rolls whenever a Character is Attempting a task. More specifically, the main kind of Attempt Roll in SF is the "Difficulty Roll." Many tasks in gaming that Players may wish to attempt can be expressed in terms of Difficulty. Difficulty is described in respect to some trait from one of the attributes of a character. A Player may add their Character's Trait value to their Difficulty Roll of 1–100 in an attempt to meet the number assigned to the Difficulty. For reference, an average human trait is 50, so a Difficulty of 50 should be nearly automatic for a typical human. An average percentile roll is 50. So an average human with an average roll should accomplish something with a Difficulty of 100 about half of the time. The best human trait is 100 and the best percentile roll is also 100. So the most adept human in the best instance might accomplish a task with a Difficulty of 200. This would, of course, not take into account bonuses or penalties from skills or circumstances of the storyline. When a Character has a Skill that is applicable to a task that is attempted, the Fates are encouraged to assign a bonus based on the Skill SOOTT. As an example, scaling a rock cliff might be described as having an agility difficulty of 120. A character with an agility of 80 would have to make a percentile roll of 40 or more to successfully scale the cliff, however the character happens to have a climbing skill of SOOTT 2, for which the fates assign a bonus of +20. So this character would only have to roll 20 or better on a percentile roll.

When playing craps in Las Vegas, rolling two "ones" with six-sided dice is called "Snake-Eyes." In StoryForge, rolling any double in a percentile (e.g., 11, 22, 33 . . . ) results in a predetermined outcome. Specifically, rolling double evens is called "Argus Eyes." Argus was a hundred-eyed guardian in Greek Mythology. Rolling Argus Eyes results in automatically getting +100 to the roll. Rolling double odds is called "Gorgon Eyes." Gorgons were devilish creatures in mythology. Rolling Gorgon Eyes results in automatically failing the attempted action. These predetermined outcomes permit increased likelihood of sporadic success and failure, especially when difficulty rolls are being made and character traits are especially high or low. These predetermined events give the most desperate act a chance of success, and make the simplest of tasks able to be botched.

SF uses the "last die" (or ones place) in Difficulty Rolls to determine certain secondary outcomes independent of the total roll. This speeds play up by making one roll apply to several things. More importantly, it separates the likelihood of succeeding the Attempt Roll and the benefit of the last die value. For example, when defending with a sword and armor, the Difficulty Roll will determine how well the defense with the sword is, but the last die will determine how well the armor protects the character. A Roll of 98 is a good percentile roll and last die value, so the weapon defense and the armor would both work well; a 91 is a good percentile but a poor last die, so the weapon defense would be good, but the armor would be unlikely to help; a 09 is a poor percentile but a good last die, so the weapon defense would likely fail, but the armor would work well; and a 01 is a poor percentile and last die, where both the weapon and armor defense are ineffective. Note that in Gorgon Eyes, the last die may still apply, so that while an active attempt at a defense with a sword may fail outright, the passive protection from armor can still apply. So while 99 and 11 are both Gorgon Eyes, the former is still usually better than the latter.

StoryForging may often flow without strict attention to time. For instance, if a group is traveling by ship across the seas, the Storyline might be described loosely in terms of days. However, during conflict resolution—when Characters are fighting, spellcasting, or choosing interactive actions—it is useful to break time into distinct units and keep track of Opp. SF uses the following terminology:

| | |
|---|---|
| Round | A full cycle of play, wherein all Characters get their Turn to act |
| Turn | A particular Character's time to go through the Maintenance and Action Phases |
| Phase | The subdivisions of a Turn in which certain Tasks are done |
| Task | The individual steps within Phases |

When several Characters engage in conflict, Initiative determines who goes first, second, and so forth. Initiative is determined by using the Mentus (acuity) score, starting from the highest, ending with the lowest. Ending Conflict can occur in several ways, such as:

| | |
|---|---|
| Death: | A Character dies when any Life Attribute becomes more negative than the Base |
| Unconscious: | When any Life Attribute becomes zero a Character becomes unconscious |
| Retreat/Flee: | Requires that a Character can outrun their opponent |
| Truce: | Characters can negotiate a peace |

During each Player's Turn, there are four Phases of Play: Maintenance Phase, Prep Phase, Non-Physical Action Phase, Physical Action Phase. But at any time, during any Player's turn, there is a set of actions available considered to be in Free Phase. The Phases of Play are outlined in detail with a list of the possible considerations within each phase. Some of the steps and gaming components will only be understood after reading subsequent sections of this description. The Phases of Play are:

- Maintenance Phase—Character Must Do All of the Following That Apply
  - Adjust Any Turn Counters & Remove Expired Elements
  - Review and Recover Opportunity
  - Pay Ongoing Losses of Life
  - Maintain Spells
- Prep Phase—Character May Choose To Do One of the Following
  - Establish or Change Focus Card
  - Adjust Psyche Counter
  - Adjust Artifact SOOTT Sliders
  - Establish or Change Style Card Action Phase—Character May Choose To Do One or Both of the Following, In Order Undertake a Non-Physical Process [Assert one Locution Card]

Undertake Any Physical Action of ~1 sec [Attack Using Artifact]

Free Phase—Character May Do Any of the Following at Any Time

Communicate

Defend Using Artifact

Resolve a Spell in the Magic Cache

Discard or Inactivate Active Element

Artifacts are interactive devices that allow Gamers to decide how weapons, tools, and technological devices perform. Not all objects or tools are Artifacts. In SF, only things that require tactical allocation of a character's resources are represented as Artifacts. A rope-ladder, for instance, is not an Artifact (FIGS. 1 & 2), but a sword is. Typically, a Player identifies their Skill SOOTT with a particular Artifact (e.g., Sword SOOTT) and may spend these like points on the Artifact's counters/sliders (FIG. 1) to affect performance. Most Artifacts have physical specifications (e.g., size, weight) as well as special functions designated upon them. Physical combat in SF involves the use of Artifacts—Body and Weapon Artifacts (FIG. 1)—the use of which consumes Opp and requires agility Difficulty Rolls to attack and defend. Additionally, defending Characters may use Armor and Shield Artifacts to reduce incoming damage—however this is passive and does not consume Opp or require Difficulty Rolls per se.

Figure 1E:
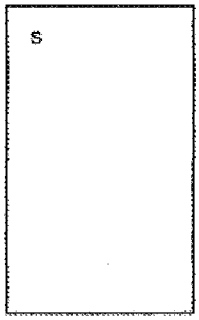
FIG. 1E: a style card, which inserts into the port on melee weapon Artifact SOOTT sliders.
Figure 1D:
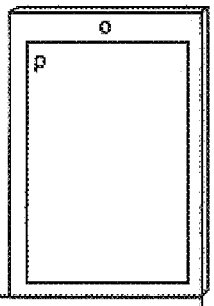
FIG. 1D: an offensive adjustable SOOTT slider, which inserts into the sheath of a melee weapon Artifact.
Figure 1C:
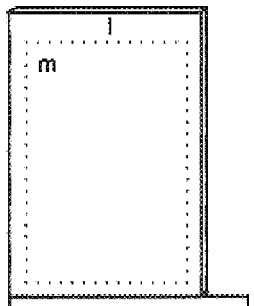
FIG. 1C: a defensive adjustable SOOTT slider, which inserts into the sheath of a melee weapon Artifact.
Figure 1C:
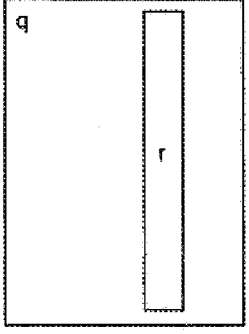
Figure 1C:
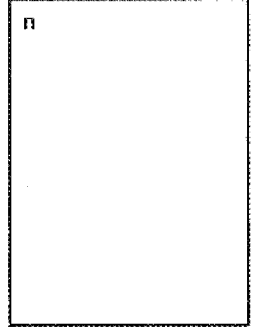

Weapon Artifacts (FIG. 1) provide Players with the information needed to attack and defend with a particular weapon. These are "Melee Weapons," indicating their use in close quarters or hand-to-hand combat, as compared with "Projectile Weapons," like Bows that can be used at great distances. Note that melee Weapon Artifacts (FIG. 1) have two interactive sides—red for Offense and green for Defense. Artifact Name & Type are indicated at the top of the Weapon Artifact (FIG. 1) sheath. This specifies the kind of Artifact and the general category to which it belongs. The category usually determines the Skill required to use the Artifact. Players may divide their Skill SOOTT value with the particular kind of Weapon between the Offensive (red) SOOTT slider (FIG. 1D) and Defensive (green) SOOTT slider (FIG. 1C). Changing these sliders alters the information in the viewing apertures. Spending more SOOTT on the Offensive SOOTT slider (FIG. 1D) will decrease the Agility Difficulty and Opportunity Costs of Offensive Maneuvers. This will also increase the Damage inflicted and the number of Offensive Effects available on the Style Card (FIG. 1E). Spending more SOOTT on Defensive SOOTT slider (FIG. 1C) will decrease the Agility Difficulty and Opportunity cost of Defensive Maneuvers, and also increase the number of Defensive Effects available on the Style Card (FIG. 1E). More potent combat Maneuvers are more Difficult and cost more Opp than less potent choices displayed on the Artifact (FIGS. 1 & 2). Because the SOOTT sliders (FIGS. 1C–D) can only be adjusted during the Prep Phase at the beginning of each Player's turn, a Character is "stuck" with whatever settings are chosen for the round. A Character can not Attack with all SOOTT spent on Offense, then change the SOOTT allocated to defense when an opponent attacks. On the face plates of the Artifact (FIGS. 1 & 2) are inscribed headings that correspond to the data revealed in the viewing apertures. These are as follows:

Offensive Side:

Maneuvers: Strike (top row) versus Assault (bottom row)

Opp Cost to Attempt Offense: This Opp must be paid before the Difficulty Roll is made Agility Difficulty: a 1–100 roll plus the Character's Agility must meet/exceed this value Base Damage: Determined by Weapon and Offensive SOOTT Variable Damage: Determined by Character's current Power Additional Opp Cost: This additional Opp cost must be paid to actually apply the Damage Defensive Side [not shown]:

Maneuvers: Deflect (top row) versus Evade (bottom row)

Figure 1B:
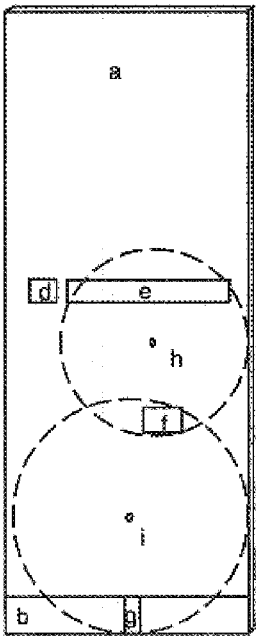
FIG. 1B: a folded melee weapon Artifact sheath as it appears from the offensive side.
Figure 1F:
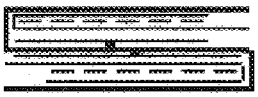
FIG. 1F: an assembled melee weapon Artifact, as it appears from the top; Column of letters indicates the 11 layers as read from the offensive face plate to the defensive face plate.

Opp Cost to Attempt Defense: This Opp must be paid before the Difficulty Roll is made Agility Difficulty: a 1–100 roll plus the Character's Agility must meet/exceed this value Damage Taken: A Character takes half damage with a Deflect and no damage with an Evade Struck or Not Struck: A Character is Struck with a Deflect and Not Struck with an Evade Additional Opp Cost: This additional Opp cost must be paid to actually reduce the Damage Each Weapon Artifact (FIG. 1) indicates a Kind of Damage that it is designed to deal. This is the default, unless an Offensive Effect on the Style Card permits use of a Secondary Kind of Damage. Different Kinds of Damage function differently depending on the target's armor. Melee Weapon Artifacts (FIG. 1) also have a Power Disk (FIG. 1B), which is set to the character's current Power. Stronger Characters may do more damage, particularly with certain weapons (e.g., a Mace) that are more power-dependant. The Artifact (FIGS. 1 & 2) has text areas where it may be described in more detail, including number of hands required for use, penalties for a typical usage, and secondary kinds of damage able to be inflicted.

A Character attacks with a Weapon Artifact (FIG. 1) by selecting an Artifact with which to attack and declaring a target. An agility Difficulty Roll is made, and the percentile roll is added to the Character's agility. The Character may choose any of the combat maneuvers on the Weapon Artifact (FIG. 1) for which they meet the agility Difficulty. The Character actually has the choice whether or not to actually apply damage by paying the Additional Opp cost associated with the Strike or Assault. If damage is dealt, the Character rolls dice to determine the variable damage and add it to the base damage. The Character then announces the Amount and Kind of damage delivered (e.g., 24 points of cut Damage).

A Character can defend anyone's attack at any time with a Weapon Artifact (FIG. 1), and can defend as many attackers as they like, until their Opp runs out. A Character must defend with whatever weapon they attacked with last turn, unless they activated a new weapon in the last turn. An agility Difficulty Roll is made, and the percentile roll is added to the Character's agility. The Character may choose any of the combat maneuvers on the Weapon Artifact (FIG. 1) for which they meet the agility Difficulty. The Character actually has the choice whether or not to actually attenuate damage by paying the Additional Opp cost associated with the maneuvers. If damage is attenuated, the Character determines by how much (as indicated on the Artifact) and subtracts it from the incoming damage.

As Characters take damage in combat, their Corpus Attribute is reduced. This, in turn, reduced the agility Trait.

This, in turn, makes Combat Difficulty Rolls harder and harder. Additionally, power is diminished, which may decrease the variable damage dealt by Weapon and Body Artifacts. Players have the choice at the beginning of each turn to adjust their Weapon Artifacts (FIG. 1)—more SOOTT could be applied to Offense or Defense to make Difficulty Rolls more obtainable. So one's fighting strategy may change as one is injured. One might even change to a weapon that is easier to use.

Style Cards (FIG. 1E) list ten Combat Effects that may be possible when fighting with that particular "Style."Each Style Card indicates any requirements on its back. Many will be usable with any weapon; however, some styles can only be applied to particular kinds of Weapons or Artifacts. The Style Cards are inserted into the Artifacts' SOOTT sliders (FIGS. 1C–D–E). This makes it so that more SOOTT spent on the slider reveals more Effects on the card. Only those Effects that are visible are available to a Character, in most instances. Style Cards may only be put into Weapon Artifact (FIG. 1) during the Prep Phase, but can be removed at any time (Free Phase). Style Cards allow for tactical combat maneuvers that may affect things other than damage. Effects can be almost anything imaginable, and generally have their mechanics indicated by the card text. More damage may be inflicted. Less damage may be received. Opp may be recovered. An Opponent's Opp may be impaired. Shield and Armor performance may be modified. Special kinds of damage may be applied to an Opponent's Mentus, or to their Artifacts. An opponent may be disarmed, forestalled, or impaired. Different Style Cards combine these Effects in different combinations. When a Character pays the Opp cost to attempt to use a Weapon Artifact (FIG. 1), the weapon may be used to apply or decrease damage, apply an effect, or both. While the designated combat maneuvers all have an agility Difficulty that must be met with a Difficulty Roll, Effects do not. Some Effects will require that a concomitant combat maneuver be performed. For instance, an Effect that reads, "Struck Opponent loses 4 Opp," is dependant upon the target being hit, so if the target successfully evades the attack, then the Effect cannot be applied. If an Effect is used, the Effect's Opp Cost must be paid in addition to any other Opp Costs from attacking or defending. So one can apply just an effect, just damage, or both, but must pay for whatever is applied.

Body Artifacts provide Players with the information needed to attack and defend with the their bodies. These are essentially like Weapon Artifacts (FIG. 1) except for a few intuitive differences. Body Artifacts can't be fumbled or taken away from a Character. They also have no Durability Counter—though, one could consider the Character's Corpus the Body's durability counter. Furthermore, Style Cards that are inserted in Body Artifacts are, in essence, Martial Arts.

Armor Artifacts (FIG. 2) provide Players with the information needed to interpret their Armor's effect on incoming damage. Unlike Weapon Artifacts (FIG. 1), which require a Skill and active decisions on the Player's part, Armor Artifacts (FIG. 2) apply passively, without Opp or Skill. When a Player rolls the dice to attempt a defense, the last die determines the initial Armor Coverage. When the defender rolls higher Armor Coverage, it means better armor function. More complete suits of Armor are protective over greater spreads of numbers. The Armor Coverage value may be modified by combat Effects or other circumstances. Once the final value is determined, it is set on the "Armor Coverage" slider (FIG. 2C). The kind of damage dealt by the weapon (Puncture, Cut, Crush, Thermal, Electrical, or Energy) is set on the "Kind of Damage" slider (FIG. 2D). The armor's performance is indicated in the Damage Reduction window (FIG. 2A). The incoming damage is reduced by this amount.

Shield Artifacts (FIG. 2) provide Players with the information needed to interpret their Shield's effect on incoming damage. It is essentially like an Armor Artifact (FIG. 2), applying passively without Opp or Skill. However, instead of Armor Coverage being determined by the last die of the Defender's Roll, Shields have a SlipShield Value determined by the last die of the Attacker's Roll. When the attacker rolls a higher SlipShield Value, it means the attack is more likely to get around the shield. Larger Shields are protective over greater spreads of numbers. The SlipShield Value may be modified by combat Effects or other circumstances. Once the final value is determined, it is set on the "SlipShield Value" slider. The kind of damage dealt by the weapon (Puncture, Cut, Crush, Thermal, Electrical, or Energy) is set on the "Kind of Damage" slider (FIG. 2D). The Shield's performance is indicated in the Damage Reduction window (FIG. 2A). The incoming damage is reduced by this amount. Armor & Shield Artifacts both provide protection, and appear very similar. The critical difference is that the last digit of the defender's Attempt Roll determines the Armor Coverage, while the last digit of the attacker's Attempt Roll determines the SlipShield Value. In this way, both might apply, one or the other might apply, or neither might apply, depending on the rolls of the two players.

Artifacts have Durability Counters (FIGS. 1B & 2B) which track any damage sustained, and how this damage affects their performance and difficulty to repair. Weapons, Armor, and Shields all have Corpus. On the Durability Counter is indicated the Artifact's remaining Corpus Points on a wheel. The Durability Threshold printed on the Artifact (FIGS. 1 & 2) is compared to an opposing Artifact's potency. If the Damage dealt or attenuated exceeds the Durability Threshold, then the Artifact loses Corpus Points. So if an attacking Artifact that deals more damage than the defending Artifact's Durability Threshold, the defending Artifact loses Corpus. And if the defending Artifact attenuates more damage than the attacking Artifact's Durability Threshold, then the attacking Artifact loses Corpus. Artifacts can damage each other simultaneously. Loss of Corpus by an Artifact will have some kind of secondary consequences. For most Artifacts, greater damage will require a better Smith SOOTT to repair the damage. For Weapons, SOOTT may be penalized. For Armor, Armor Coverage may be diminished. For Shields, the SlipShield Value may be adjusted to give the attacker an advantage. The Artifact may lose value. When the Durability Counter shows the Artifact has a Corpus of zero, the Artifact is considered destroyed.

In SF, spellcasters have a vocabulary of magical words, phrases, and sentences called Locutions, represented by Locution Cards (FIGS. 4A–B). Locutions Cards are combined into Spells, just like words are combined in a sentence. There are four kinds of Locution Cards, each with two sub-types:

| | |
|---|---|
| Nouns | Specifies the subject(s) & object(s) of spells that are affected by the Verb |
| Indication | Indicates existing Nouns; can't be used to Create/Destroy Nouns. General terms. |
| Essence | Specifies Nouns that may be Created/Destroyed/Transformed. Specific terms. |

-continued

| | |
|---|---|
| Verbs | Specifies the action(s) that Spell Nouns undergo or experience |
| Intransitive | Relates only to a Subject Noun; Does not take an Indirect Object Noun (eg, Fly) |
| Transitive | Relates the action of a Subject Noun to a required Indirect Object Noun (eg, Create) |
| Modifiers | Specifies some quality of nouns or verbs in a spell (not required for a Spell) |
| Adjectives | Describes/modifies a Spell Noun (eg, Large) |
| Adverbs | Describes/modifies a Spell Verb (eg, Quickly) |
| Combination | Combines the above types of cards into one |
| Phrase | Combines two or more Nouns, Verbs, or Modifiers, but is not a complete sentence |
| Sentence | Combines sufficient Nouns, Verbs, or Modifiers to be a complete sentence |

Each Locution Card indicates several things:

| | |
|---|---|
| Name/Locution: | Unique identifier and the magical sound or feeling created |
| Interpretation: | The conceptual meaning of the Locution(s) |
| Grammatical Role: | The Part(s) of Speech in the final Spell |
| Effect: | Results/Consequences of the Locution(s) |
| Example: | Locution used in an example |
| Difficulty: | Difficulty in terms of a Trait to Assert the Locution(s) into the Magic Cache |
| Opp Max Reduction: | Opp Max Penalty for activated Locutions & Spells |
| Costs: | Drain on Cost Buffer and/or Life Points of spellcaster |
| Border/Arrows: | Color-coded borders and icons demonstrate required and permitted card interactions |

The specific Spellcaster's magic vocabulary (set of Locution Cards) is their Lexicon Instead of selecting from a set of prefabricated Spells, Locution Cards can be combined on the spot in many permutations to form Sentences designed for specific needs (FIG. 4B). The borders of the cards indicate what card-card interactions are permitted and required, making the grammar of spellcasting intuitive and foolproof. A Spell (FIG. 4B) is a complete sentence composed of Locutions that have successfully resolved. Every Spell begins with and contains only one Verb Locution. To its left, a green arrow will indicate that a Noun with a green arrow must be placed there. A Verb may or may not have an orange arrow on the right indicating that a Noun with an orange arrow must be placed there Nouns and Verbs line up horizontally, and multiple Nouns may be daisy-chained (i.e., linked one-to-another) if the arrows permit. Nouns may have a yellow arrow indicating that an Adjective may be placed above it, modifying that Noun. Verbs may have a red arrow indicating that an Adverb may be placed above it, modifying that Verb Multiple Adjectives and Adverbs can usually be daisy-chained vertically. In most instances, Adjectives and Adverbs are optional. Locution Phrases are simply two or more Locution Words which have been fused, but still require further Locutions to complete a sentence—which can then resolve into a spell Some Locution Cards have special interactions that should always be apparent from the card borders and Effect text.

The Spiritus Slider (FIG. 3A) includes crucial information on a Character's magical abilities. The ability to project magic is based on the Presence Trait, while the ability to resist magic depends on the Will Trait. Successfully casting a spell also depends on making a Difficulty Roll based on the Attribute Trait indicated on the Locution Card. Casting Magic may drain Life Points, usually Spiritus or Mentus, which in turn decreases casting potency and resistance, as well as Aura size.

Psyche is a measure of a spellcaster's magical prowess. It is equal to a character's Immortality SOOTT plus Magic SOOTT. The Psyche Counter is stored in the side pocket of the Spiritus Attribute Sheath. It is a simple device with several disk counters that spellcasting characters use to keep track of their magical limitations. The three aspects (each represented with a disk) that Psyche points may be spent on are:

| | |
|---|---|
| Casting Bonus: | This bonus may be added to the difficulty roll when casting magic |
| Spell Range: | The spell range in any direction |
| Cost Buffer: | The magical energy points a spellcaster can spend each Round before Life Points are drained. |

This Psyche Counter can be used to apportion a spellcaster's abilities on those things that are most needed, but it is always a trade-off. For a difficult spell, Psyche may need to be allocated to the Casting Bonus, but this limits the Range and Cost Buffer. A Spell that needs to be cast a long way off might not leave much Psyche for a Casting Bonus or the Cost Buffer. Conversely an easy Spell that can be cast close at hand could leave the spellcaster with a large Cost Buffer.

Casting a spell begins during a spellcaster's Prep Phase, when the Psyche Points are spent on the Psyche Counter. During the Non-Physical Action Phase, a Character may assert one Locution Card into their Magic Cache—the place magic exists before it resolves into a Spell and takes effect A spellcaster must successfully make the Difficulty Roll indicated on the card to place it in the Magic Cache, where it is on stand-by. Failure to make the Difficulty Roll causes the loss of the Character's turn (including the Physical Action Phase). At any time (i.e., Free Phase), a spellcaster may choose to resolve any successfully asserted Locutions that comprise a complete spell by making a Resolution Roll A Resolution Roll is a Spiritus (presence) Difficulty Roll made at the moment a spellcaster wishes the Locutions to become a Spell and take effect. Failure to meet this Resolution Difficulty Roll causes the Locution Cards that were being attempted to be returned to the Lexicon. Similarly, when Spells are quit, cannot be maintained, or if a spell target leaves the caster's range, the spell is broken, and the Locution Cards return to the Character's Lexicon. As Locutions are asserted and spells maintained, the spellcaster may have to pay for the effects with life points, Opp points, or both.

A complete Spell example follows. A spellcaster with a Presence of 90, Magnetism of 90, Abstraction of 80, Intuition of 80, Magic SOOTT of 7, Immortality of 3, and Psyche 10 (7 SOOTT plus 3 Immortality) wishes t princess with a Will of 120. The spellcaster has distributed his 10 points of Psyche on his Psyche Counter as follows:

5 Psyche on the Casting Bonus disk reveals a bonus of +50 for his Difficulty Roll 0 Psyche on the Spell Range disk reveals that he must be in contact with the spell target 5 Psyche on the Cost Buffer disk reveals a 15 life point reservoir of free points Three Locution Cards will be required:

| Locution Card | Effect | Difficulty | Cost | Opp Max |
|---|---|---|---|---|
| Ego - "I"<br>Indication Noun<br>Spell Subject | Specifies the Spellcaster as either a Subject (I) or Object (Me) in a Spell | Mentus (Abstract.)<br>50 | free | −0 |
| Corphant - "Seduce"<br>Transitive Verb<br>Spell Verb | Sentient Spell Object becomes seduced by Spell Subject. Seduced beings will be attracted to and protective of the Spell Subject | Spiritus (Magnetism)<br>200 | 15 Spiritus<br>Maintenance:<br>6 Spiritus | −6 |
| Sentius - "Being" = princess<br>Indication Noun<br>Spell Object | Specifies a whole living being. | Spiritus (Intuition)<br>80 | 1 Spiritus per<br>Immortality<br>SOOTT (so 3) | −3 |
| Totals | | | 18 Spiritus | −9 |

For the Locution Cards "Ego" and "Sentius," the difficulties are less than the spellcaster's Traits, so he need only not roll Gorgon Eyes to get these two cards into play. To meet the Magnetism Difficulty of 200 for "Corphant" with a Magnetism of 90 and a Casting Bonus of +50, the spellcaster would need to roll a 60 or better. Based on a Cost Buffer of 15, if he succeeded, he would only pay 3 Spiritus (18 total cost minus 15 buffer) for Asserting Corphant, sin the Maintenance and Assertion Costs for the other Locutions are each less than 15. His Opp Max would be at a total of −9 while this spell was in effect.

As can be appreciated by the preceding detailed game description the present invention provides a role playing game that uniquely employs familiar devices—namely cards, slide rules, and dice—to create a gaming experience that is open-ended, strategic, tactile, and modular. It is anticipated that further development of the present invention by the inventors or an assignee will be made including new cards and gaming devices that fall within the scope of the present invention. Furthermore, changes and modifications of the game described herein may be made that do not change the spirit of the present invention.

The inventors claim:

1. A method of playing games involving two or more players, the method being suitable for games having rules for game play that include instructions on selecting game components, and a plurality of game components, the method comprising the steps of:

a. providing a means for random number generation;

b. providing at least one imaginary character for each of said players; and c. providing at least one interactive slide rule device, wherein each said at least one interactive slide rule device i. represents a specific dynamic asset exertable by said at least one imaginary character in situational game context, wherein said dynamic asset is selected from the group consisting of weapons, armor, corporeal embodiments, vehicles, computers, brains, machines, technological instruments, magical items, and souls; and ii. comprises correlations between input variables derived from said situational game context in which said at least one imaginary character exists, and dependant output data describing the function and potency of said specific dynamic asset.

2. The method of claim 1, wherein each of said at least one interactive slide rule device comprises:

a. one or more tables containing said input variables and said dependent output data; and b. means for restricting all possible said input variables and all possible said dependent output data to said input variables and said dependent output data relevant to situational game context.

3. The method of claim 2, wherein said at least one interactive slide rule device further comprises one or more docking ports for modular cards that overlay said one or more tables.

4. The method of claim 1, further comprising the step of providing one or more magic cards representing magical effects exerted by said at least one imaginary character, wherein each of said magic cards represents a grammatical element of a sentence selected from nouns, verbs, adverbs, and adjectives, said magical effects being exertable when a complete sentence is formed by combining said one or more magic cards.

5. The method of claim 4, wherein each of said one or more magic cards has a perimeter specific to the grammatical part of speech represented, said perimeter further comprising indicators to direct proper sentence assembly obviating the need to understand rules of grammar.

* * * * *